US007398823B2

(12) United States Patent
Montgomery et al.

(10) Patent No.: US 7,398,823 B2
(45) Date of Patent: Jul. 15, 2008

(54) SELECTIVE ELECTROMAGNETIC PRODUCTION TOOL

(75) Inventors: Carl T. Montgomery, Bartlesville, OK (US); Daniel R. Maloney, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 246 days.

(21) Appl. No.: 11/032,657

(22) Filed: Jan. 10, 2005

(65) Prior Publication Data

US 2006/0151166 A1 Jul. 13, 2006

(51) Int. Cl.
*E21B 43/24* (2006.01)

(52) U.S. Cl. ..... 166/272.1; 166/248; 392/301; 392/304; 392/306

(58) Field of Classification Search ..... 166/245, 166/248, 272.1, 272.2; 392/301, 304, 306
See application file for complete search history.

(56) References Cited

U.S. PATENT DOCUMENTS

| | | | | |
|---|---|---|---|---|
| RE30,738 | E | 9/1981 | Bridges et al. | |
| 4,485,868 | A | 12/1984 | Sresty et al. | |
| 4,485,869 | A | 12/1984 | Sresty et al. | |
| 4,645,004 | A | 2/1987 | Bridges et al. | |
| 4,662,438 | A | 5/1987 | Taflove et al. | |
| 5,012,868 | A | 5/1991 | Bridges | |
| 5,339,898 | A * | 8/1994 | Yu et al. | 166/248 |
| 5,620,049 | A | 4/1997 | Gipson et al. | |
| 5,621,844 | A | 4/1997 | Bridges | |
| 5,784,530 | A | 7/1998 | Bridges | |
| 6,427,774 | B2 | 8/2002 | Thomas et al. | |
| 6,463,608 | B1 | 10/2002 | Moe | |
| 6,495,112 | B2 | 12/2002 | Duchane et al. | |
| 6,520,256 | B2 | 2/2003 | Ferg | |
| 6,561,041 | B1 | 5/2003 | Eck | |
| 6,561,274 | B1 | 5/2003 | Hayes et al. | |
| 6,616,493 | B2 | 9/2003 | Powell et al. | |
| 6,629,562 | B1 | 10/2003 | Fidan | |
| 6,675,893 | B2 | 1/2004 | Lund | |
| 6,689,953 | B2 | 2/2004 | Baldwin | |
| 6,840,337 | B2 * | 1/2005 | Terry et al. | 175/38 |
| 6,991,032 | B2 * | 1/2006 | Berchenko et al. | 166/245 |
| 2003/0173081 | A1 | 9/2003 | Vinegar et al. | |
| 2005/0199386 | A1 * | 9/2005 | Kinzer | 166/248 |

* cited by examiner

*Primary Examiner*—Jennifer H Gay
*Assistant Examiner*—Brad Harcourt
(74) *Attorney, Agent, or Firm*—Ryan N. Cross; Kameron D. Kelly

(57) ABSTRACT

A method for resistively heating a subterranean region to lower the viscosity of heavy oil by using production tubing coupled to at least two electrodes modified for three-phase flow and an electrically insulating body.

50 Claims, 6 Drawing Sheets

SELECTIVE ELECTROMAGNETIC PRODUCTION TOOL

BACKGROUND OF THE INVENTION

1. Field of the Invention

The present invention relates generally to an improved method and apparatus for the recovery of highly viscous oil in subterranean deposits. In one aspect, the invention concerns a method of resistively heating the subterranean formation to lower the viscosity of the oil. In another aspect, the invention concerns a heating and production apparatus comprising a flexible production tubing. In another aspect, the invention concerns a method of completing a well by inserting into the fluid-filled well bore production tubing modified with a buoyant body.

2. Discussion of the Prior Art

Heavy oil is naturally formed oil with very high viscosity that often contains impurities such as sulfur. While conventional light oil has viscosities ranging from about 0.5 centipoise (cP) to about 100 cP, heavy oil has viscosities that range from 100 cP to over 1,000,000 cP. Heavy oil reserves are estimated to equal about 15% of the total remaining oil resources in the world. In the United States alone, heavy oil resources are estimated at about 30.5 billion barrels, and heavy oil production accounts for a substantial portion of domestic oil production. For example, in California alone, heavy oil production accounts for over 60% of the state's total oil production. With new reserves of conventional light oil becoming more difficult to find, improved methods of heavy oil extraction have become more important. Unfortunately, heavy oil is typically expensive to extract, and conventional methods have only about 10 to 30% recovery rates of heavy oil from existing reserves. Therefore, there is a compelling need to develop a more efficient and effective means for the extraction of heavy oil.

One of the ways in which heavy oil can be recovered is through electromagnetic stimulation. This involves lowering the viscosity of heavy oil by heating it with electricity. There are several different methods of electromagnetic stimulation, including, for example, inductive heating, microwave heating, and resistive heating. Inductive heating utilizes a downhole heating element that directly turns the current into heat. Microwave heating utilizes very high frequency energy to heat the reservoir. Resistive heating utilizes an electrode that is grounded to an adjacent well bore or to the surface. The electric current from the electrode in this method is conducted by connate brine in the reservoir. Resistive heating essentially heats the subterranean formation surrounding the heavy oil, resulting in the oil being heated and lowering its viscosity.

Electromagnetic stimulation is, in theory, the ideal way to lower the viscosity of heavy oil because of the wide availability of electricity and because it requires a minimal surface presence. However, the results have not lived up to theory. There have been many different designs for electromagnetic stimulation of heavy oil reserves, but none have worked well enough to gain widespread acceptance. This is primarily because the prior art has not developed an economical and robust downhole deployment system for electromagnetic stimulation.

Among the methods of electromagnetic stimulation, resistive heating seems to hold the most promise as a reliable means of lowering the viscosity of heavy oil. One reason for this is that resistive heating does not require any type of injection, because the current simply flows through the conductive brine of the oil well. However, as in other types of electromagnetic stimulation, there has yet to be a widely accepted system for resistive heating. Thus, there remains the need for an electromagnetic heating system that is effective in increasing the productive output of heavy oil reservoirs.

Oil and/or natural gas wells are often drilled horizontally in several directions from one well head for a variety of reasons. However, one problem with the completion of horizontal wells is that it is difficult to extend production tubing to the end of the well. Therefore, there is also a need for a method to more effectively complete a horizontal well.

OBJECTS AND SUMMARY OF THE INVENTION

Responsive to these and other problems, an object of the present invention is to provide a more efficient and effective method of extracting heavy oil.

A further object of the present invention is to provide an apparatus which provides an effective means of resistively heating a subterranean oil resevoir so that heavy oil can be extracted.

Another object of the present invention is to provide a more effective means for completing a horizontal oil and/or gas well.

It should be noted that not all of the above-listed objects need be accomplished by the invention claimed herein and other objects and advantages of this invention will be apparent from the following description of the invention and the appended claims.

In accordance with one embodiment of the invention, there is provided a method for resistively heating a subterranean region. The method includes causing electricity to pass through the region between two or more spaced-apart electrodes. The electrodes are coupled to production tubing disposed within the region.

In accordance with another embodiment of the invention, there is provided a method for resistively heating a subterranean region. The method includes causing electricity to pass through the region between two or more electrodes. The electrodes being coupled to a common length of production tubing and spaced apart from one another along the length of the tubing.

In accordance with another embodiment of the invention, there is provided a reservoir heating apparatus configured for attachment to production tubing. The apparatus includes an elongated electrically insulating body and a plurality of electrically conductive electrodes. The apparatus is shiftable between a disassembled configuration wherein the apparatus is decoupled from the tubing and an assembled configuration wherein the apparatus is coupled to the production tubing. The electrodes are spaced from one another along the length of the body when the apparatus is in the assembled configuration. The body electrically insulates the electrodes from the tubing when the apparatus is in the assembled configuration.

In accordance with still another embodiment of the invention, there is provided a system for resistively heating a subterranean region. The system includes a first length of production tubing; a second length of production tubing spaced from the first length of production tubing; a series of electrically connected first electrodes spaced along the length of the first length of production tubing; and a series of electrically connected second electrodes spaced along the length of the second length of production tubing.

In accordance with a further embodiment of the invention, there is provided a method for completing a well comprising: (a) coupling a low-density body to a length of production tubing; and (b) inserting the length of production tubing into a hole containing a fluid of greater density than the body.

BRIEF DESCRIPTION OF THE DRAWING FIGURES

Preferred embodiments of the invention are described in detail below with reference to the attached drawing figures, wherein.

Figure 7:
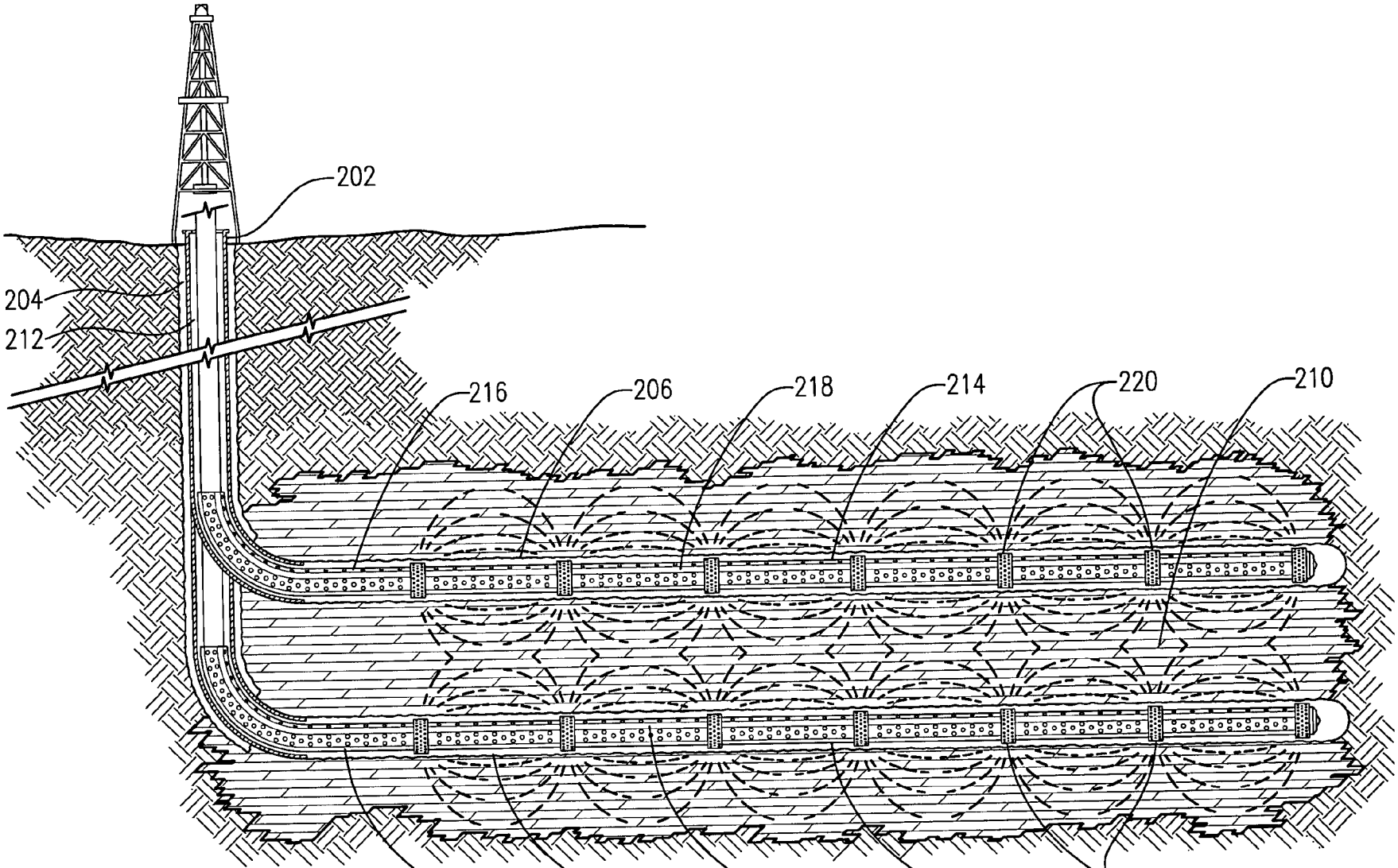
Figure 8:
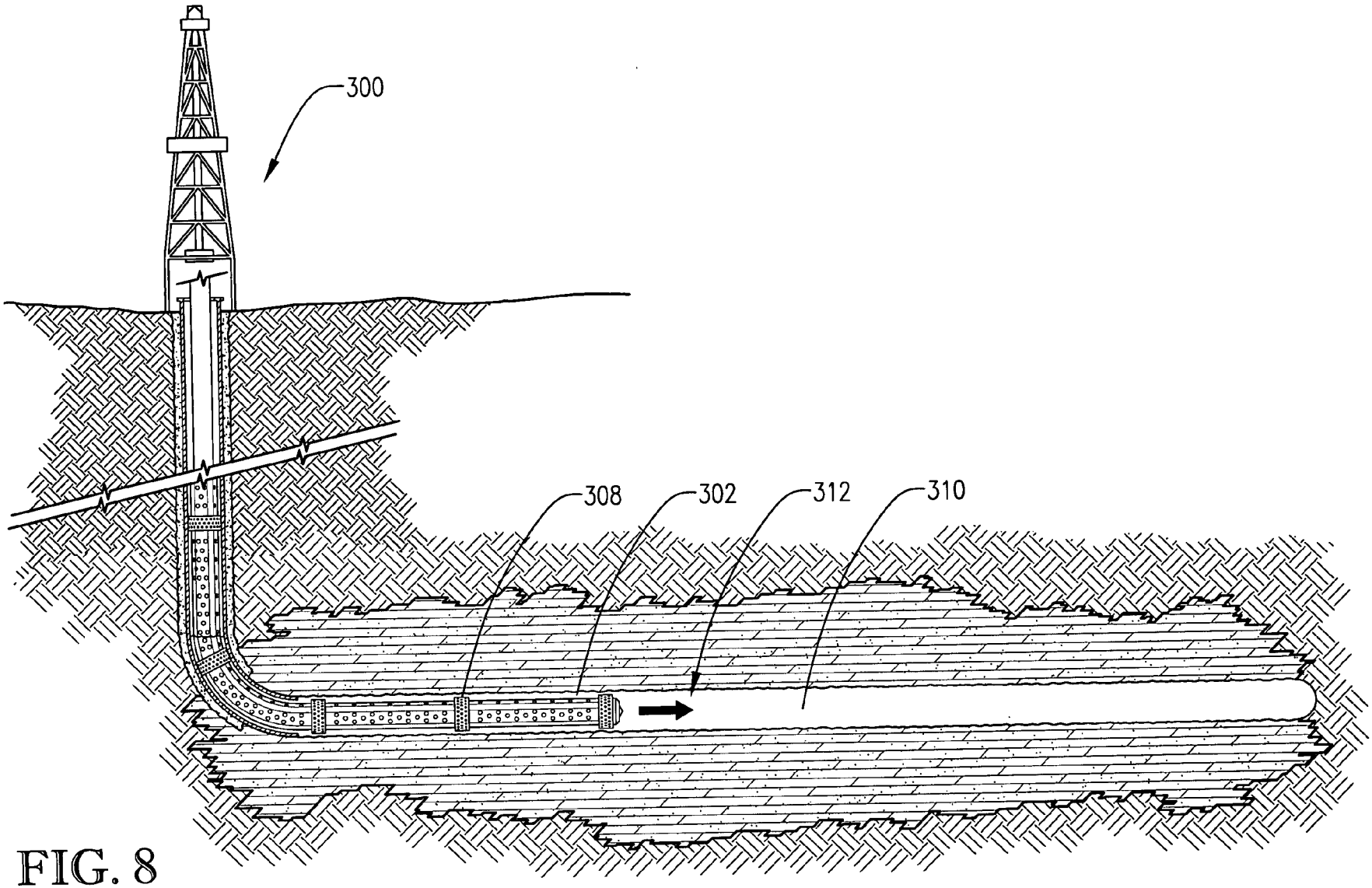

FIG. 7 is a schematic diagram illustrating a heavy oil heating system according to one embodiment of the present invention disposed within two parallel well bores; and FIG. 8 is a schematic diagram illustrating the completion of an oil and/or gas well according to one embodiment of the present invention, particularly illustrating the extension of production tubing equipped with a buoyant body into a horizontal well filled with a liquid.

DETAILED DESCRIPTION OF THE PREFERRED EMBODIMENTS

Figure 1:
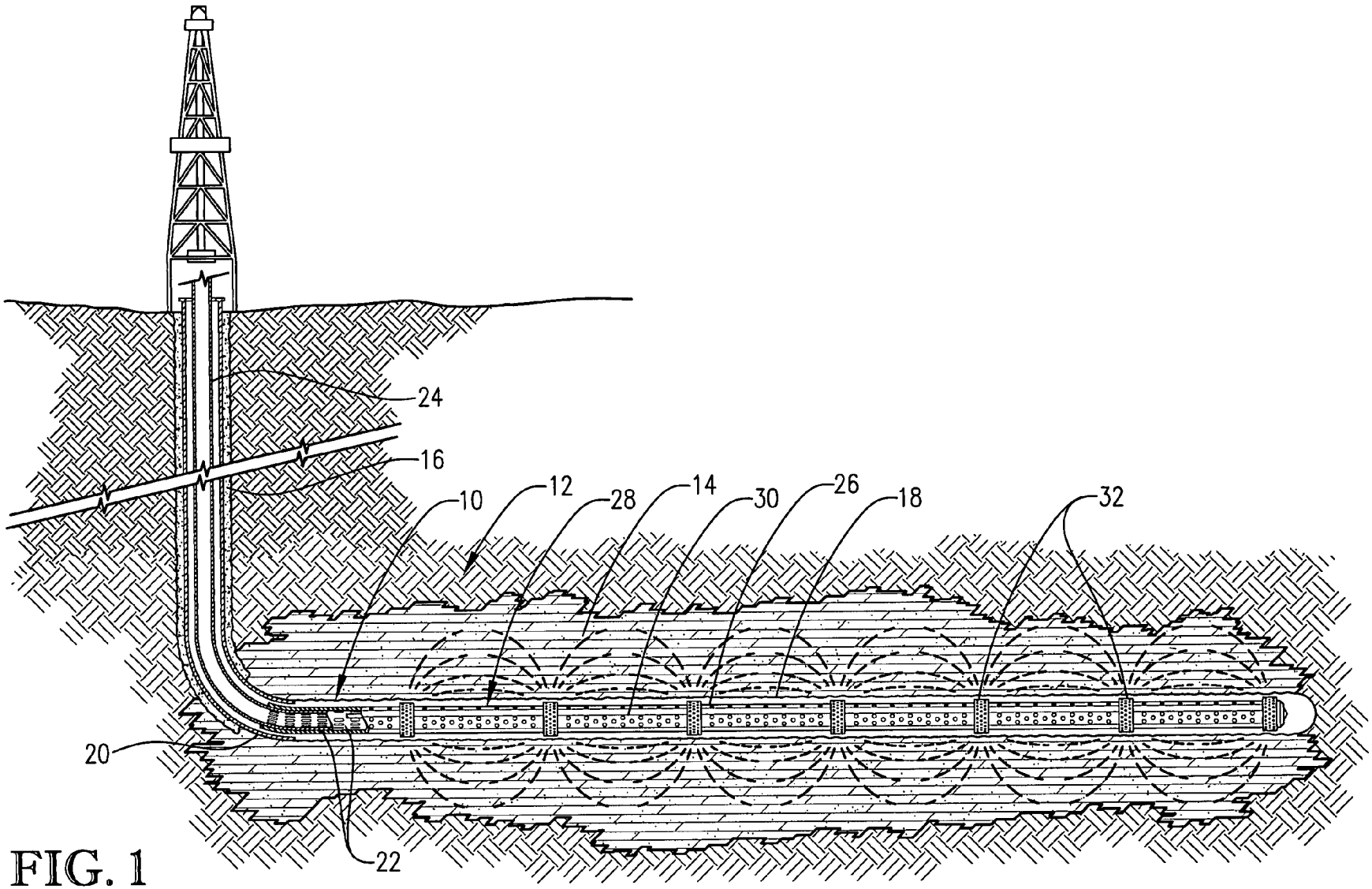
FIG. 1 is a schematic diagram illustrating a heavy oil heating apparatus according to one embodiment of the present invention, particularly illustrating the heating apparatus coupled to a length of production tubing extended in a horizontal portion of a well bore.
Figure 2:
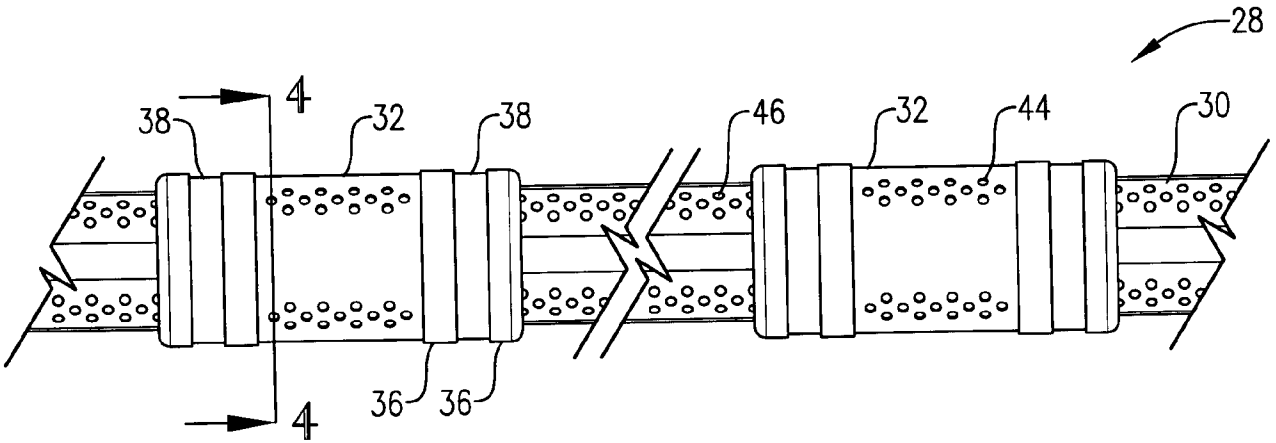
FIG. 2 is an enlarged partial side view of a portion of the heating apparatus of FIG. 1, particularly illustrating the insulating body and spaced apart electrodes of the heating apparatus.
Figure 3:
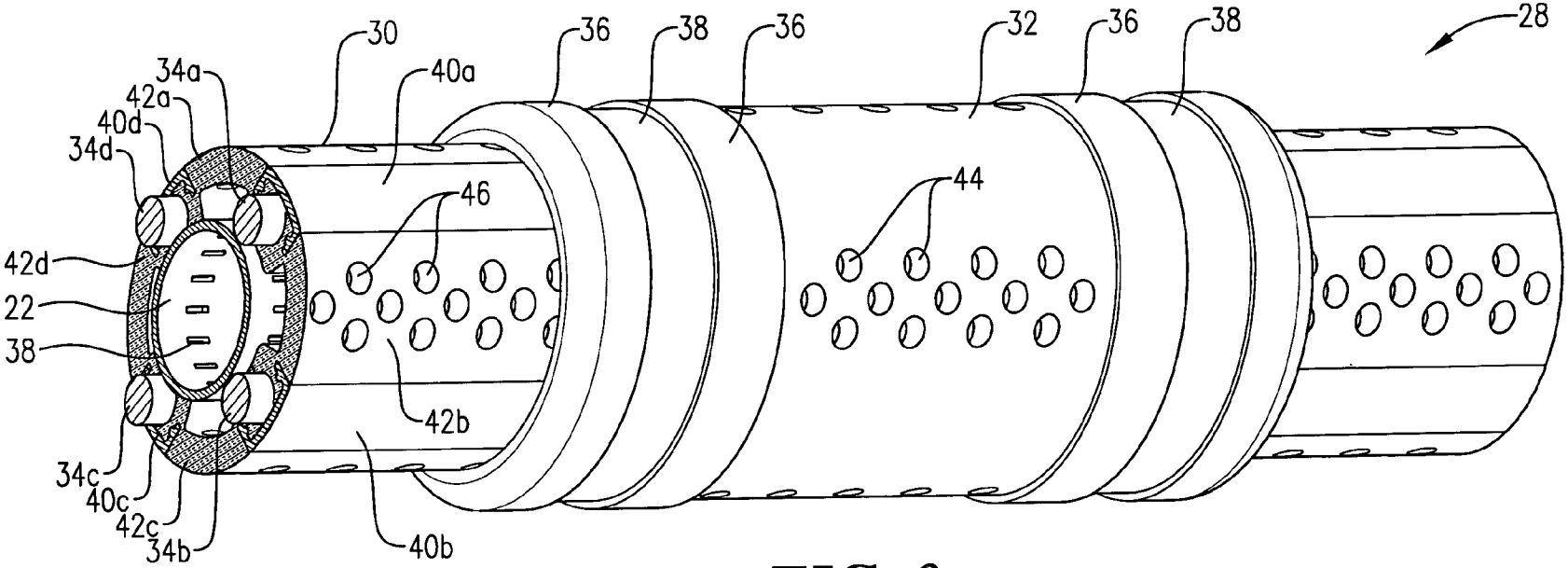
FIG. 3 is a an enlarged isometric view of a portion of the heating apparatus of FIG. 1, particularly illustrating the manner in which the power lines, electrodes, and insulating body are coupled to and disposed around the production tubing.

Turning initially to FIG. 1, a well bore 10 is illustrated as extending in a subterranean formation 12 proximate an oil-bearing portion 14 of subterranean formation 12. Well bore 10 includes a cased section 16 and an uncased section 18. Cased section 16 of well bore 10 is cased with casing 20 and extends in a substantially vertical fashion. Uncased section 18 of well bore 10 is not cased. In one embodiment of the present invention, uncased section 18 of well bore 10 extends in a substantially horizontal fashion proximate oil-bearing portion 14 of subterranean formation 12. In another embodiment of the present invention, uncased section 18 of well bore 10 extends in a substantially vertical fashion proximate oil-bearing portion 14 of subterranean formation 12. In yet another embodiment of the present invention, uncased section 18 of well bore 10 extends in a substantially sloped fashion proximate oil-bearing portion 14 of subterranean formation 12. A production tubing 22 is disposed within well bore 10. Preferably, production tubing 22 is a conventional flexible metallic tubing such as, for example, coiled tubing. Alternatively, production tubing 22 is substantially composed of non-conductive material, such as plastic or fiberglass. In the further alternative, production tubing 22 is a conventional flexible metallic tubing including electrical insulators between each section of the tubing. An unmodified portion 24 of production tubing 22 extends into cased section 16 of well bore 10, while a modified portion 26 of production tubing 22 extends into uncased section 18 of well bore 10. Modified portion 26 of production tubing 22 is perforated to permit oil disposed in uncased section 18 of well bore 10 and originating from oil-bearing portion 14 of subterranean formation 12 to enter production tubing 22.

Modified portion 26 of production tubing 22 is equipped with a heating and production apparatus 28. Heating and production apparatus 28 generally comprises an electrically insulating body 30 and a plurality of electrodes 32. Insulating body 30 is coupled to and extends along the length of modified portion 26 of production tubing 22. Electrodes 32 are generally ring-shaped and are coupled to and extend around insulating body 30. Electrodes 32 are made of an electrically conductive material, preferably metal, most preferably stainless steel. Electrodes 32 are spaced from one another along the length of modified portion 26 of production tubing 22. As described in detail below, electrodes 32 can be electrified to cause resistive heating of oil-bearing portion 14 of subterranean formation 12. Insulating body 30 is operable to electrically insulate production tubing 22 from electrodes 32. It is preferred for heating apparatus 28 to include at least 2 electrodes 32, more preferably at least 4 electrodes 32, and most preferably 6 to 20 electrodes 32. Preferably, electrodes 32 are spaced from one another along the length of production tubing 22 by about 25 to about 500 feet, more preferably about 50 to about 200 feet. Preferably, each electrode 32 has a length of about 1 to about 10 feet, more preferably about 2 to about 5 feet. In a preferred embodiment of the present invention, insulating body 30 extends continuously along a substantial length (preferably all) of modified portion 26 of production tubing 22. Preferably, insulating body 30 continuously extends at least about 300 feet along the length of production tubing 22, more preferably about 400 to about 2,000 feet along the length of production tubing 22.

Turning now to FIGS. 2-5, in a preferred embodiment of the invention, heating and production apparatus 28 includes insulating body 30, electrodes 32, power lines 34, insulating collars 36, fastening collars 38, and C-clips 40. Insulating body 30 comprises a plurality of, preferably four, individual body sections 42*a,b,c,d*. Each of the preferably four power lines 34*a,b,c,d* is disposed between a respective body section 42*a,b,c,d*. C-clips 40 are preferably formed of a flexible, electrically insulating material such as plastic. Each C-clip 40*a,b,c,d* holds a respective pair of body sections 42*a,b,c,d* together and holds a respective power line 34*a,b,c,d* in place within insulating body 30. In this manner, insulating body 30 is operable to electrically insulate power lines 34*a,b,c,d* from each one another, from production tubing 22, and from electrodes 32. Insulating collars 36 are operable to further insulate electrodes 32 and production tubing 22 from power lines 34. Fastening collars 38 are operable to securely couple insulating collars 36 to insulating body 30. In addition, fastening collars 38 help hold individual body sections 42*a,b,c,d* together. Each electrode 32 extends around and is coupled to a respective insulating collar 36. As perhaps best illustrated in FIGS. 3-5, each electrode 32 defines a plurality of electrode perforations 44, each insulating collar 36 defines a plurality of collar perforations 46, insulating body 30 defines a plurality of insulating body perforations 48, and production tubing 22 defines a plurality of tubing perforations 50. As perhaps best illustrate in FIGS. 4 and 5, it is preferred for electrode, collar, and body perforations 44, 46, and 48 to be substantially aligned so as to form a flow channel 52 that permits fluid flow therethrough and into production tubing 22.

Figures 4, 6:
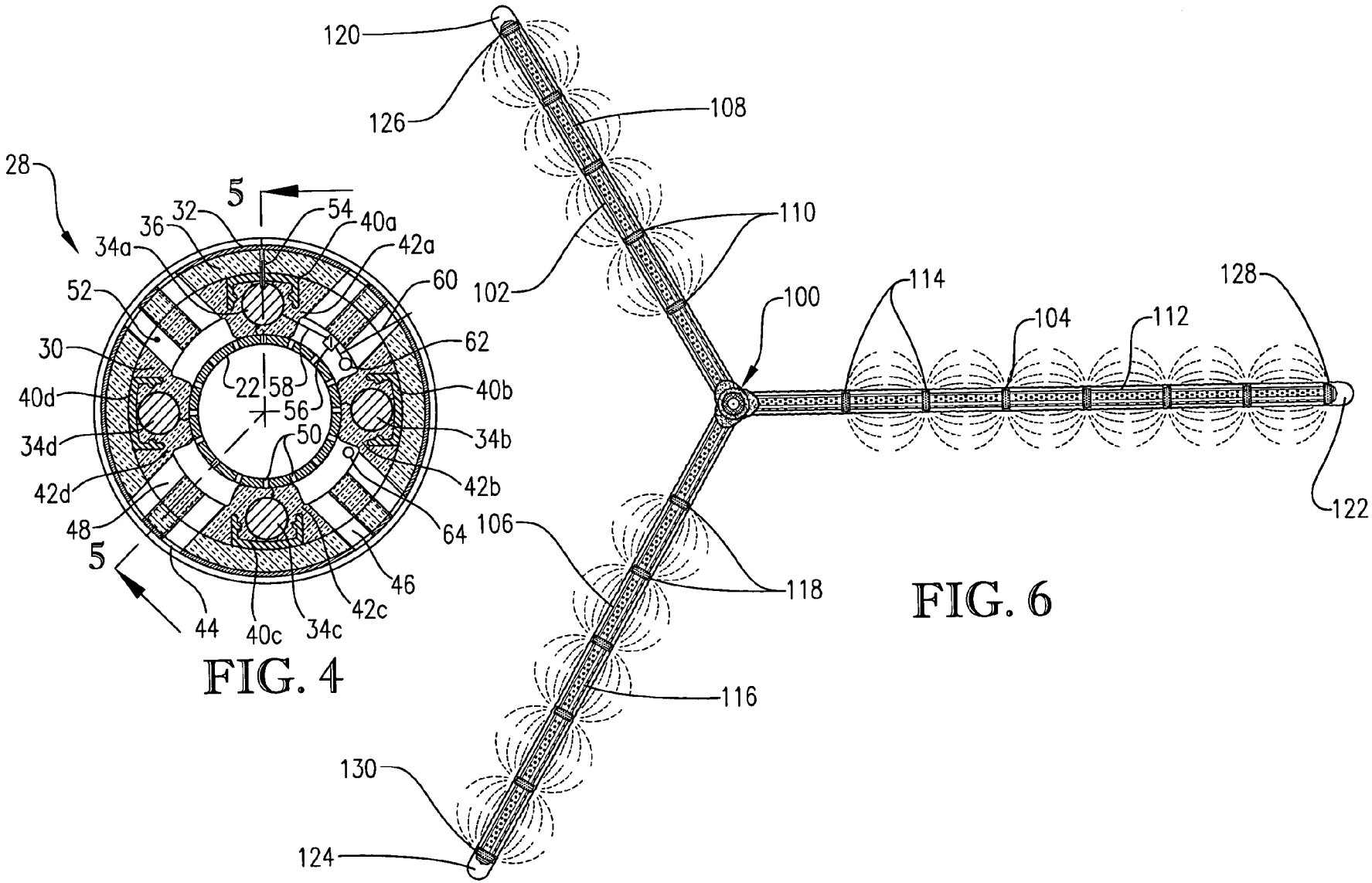
FIG. 4 is a sectional view of the heating apparatus taken along line 4-4 in FIG. 2, further illustrating the manner in which the power lines, electrodes, and insulating body are coupled to and disposed around the production tubing.
FIG. 6 is a top view of an alternative heavy oil heating system according to one embodiment of the present invention, particularly illustrating three heating apparatus sections disposed in three radially-extending horizontal well bores.
Figure 5:
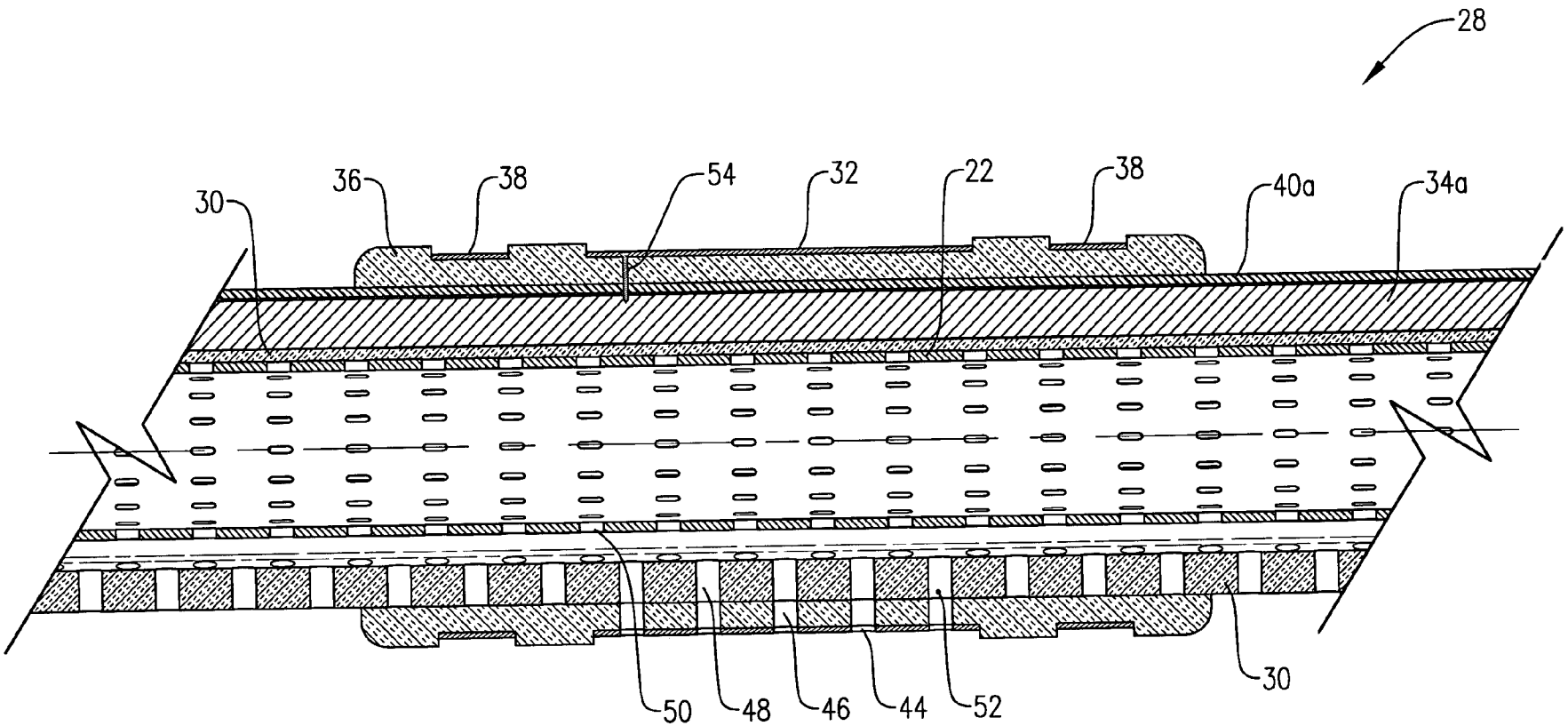
FIG. 5 is a sectional view taken along line 5-5 in FIG. 4, further illustrating the electrode, insulating body, and power lines.

Referring again to FIGS. 4 and 5, heating and production apparatus 28 also includes an electrical connection means for electrically connecting each electrode 32 to a single one of the power lines 34. In one embodiment of the present invention, this electrical connection means is provided by a jumper screw 54 that extends through electrode 32, though insulating collar 36, though C-clip 40, and into contact with power line 34. Referring to FIG. 4, in another embodiment of the present invention, the electrical connection means is provided by a switch 56. Switch 56 includes a first conductive element 58 connected to one of the power lines 34 and a second conductive element 60 connected to electrode 32. A control line 62 can be provided to selectively electrify electrode 32 by turning switch 56 on and off. Thus, in this embodiment, each electrode 32 spaced along the length of production tubing 22 can be individually turned on and off. In another embodiment of the present invention, a thermocouple 64 is provided along the length of production tubing 22. Thermocouple 64 is preferably a fiberoptic cable, and is operable to measure the temperature of well bore 10 and subterranean formation 12.

Referring again to FIGS. 3-5, as mentioned above, production tubing 22 can be conventional tubing that is modified to include heating and production apparatus 28 after the manufacture of production tubing 22, or production tubing 22 may alternatively be composed of non-conductive material that is modified to include heating and production apparatus 28. In another embodiment of the present invention, production tubing 22 may comprise conventional production tubing that includes insulators between each section of tubing and is modified to include heating and production apparatus 28. In order to modify production tubing 22 to include heating and production apparatus 28, heating and production apparatus 28 must be transformed from a disassembled configuration (where apparatus 28 is decoupled from production tubing 22) to an assembled configuration (where apparatus 28 is coupled to production tubing 22). In order to couple heating and production apparatus 28 to production tubing 22, power lines 34*a,b,c,d* are placed between body sections 42*a,b,c,d*; body sections 42*a,b,c,d* are placed around production tubing 22; C-clips 40*a,b,c,d* are used to secure body sections 42*a,b,c,d* on production tubing 22; insulating collar 36 is placed over insulating body 30; fastening collars 38 are placed around insulating collar 36; and electrode 32 is placed over insulating collar 36.

Referring again to FIGS. 1-5, in order to heat oil-bearing portion 14 of subterranean formation 12, two or more electrodes 32 are electrified or wounded. Electrifying the electrodes 32 causes electricity to pass through subterranean formation 12 from an electrified electrode to a wounded electrode 32. The electrical resistance provided by subterranean formation 12 resistively heats subterranean formation 12 and the fluids contained therein. Preferably, oil-bearing portion 14 of subterranean formation 12 contains a highly viscous oil. The resistive heating of subterranean formation 12 causes the high viscous oil to become less viscous, so that it can easily flow into uncased portion 18 of well bore 10. Once in well bore 10, the heated oil can easily be withdrawn from well bore 10 via production tubing 22.

Referring again to FIGS. 1-5, in one embodiment of the invention, power lines 34*a,b,c* are charged with three-phase electricity, while power line 34*d* serves as a ground. In this embodiment, switch 56 is operable to connect electrode 32 with one of power lines 34*a,b,c,d*. Thus, all of the electrodes 32 on apparatus 28 can be electrified at a desired phase. In another embodiment of the present invention, thermocouples 60 are used to generate a temperature profile of the subterranean formation 12. Using this profile, electrodes 32 can be electrified or grounded in order to optimize the temperature profile of oil-bearing portion 14 of subterranean formation 12 for the flow of heavy oil into production tubing 22.

Turning now to FIG. 6, in another embodiment of the invention, heating and production apparatus 100 has a first production leg 102, a second production leg 104, and a third production leg 106. First production leg 102 comprises a first insulating body 108 extended around production tubing and a first set of electrodes 110; second production leg 104 comprises a second insulating body 112 extended around production tubing and a second set of electrodes 114; and third production leg 106 comprises a third insulating body 116 extended around production tubing and a third set of electrodes 118. Each production leg can be assembled in substantially the same manner as heating and production apparatus 28 in FIGS. 1-5 described above. The first production leg 102 is disposed in a first well bore 120; a second production leg 104 is disposed in a second well bore 122; and a third production leg 106 is disposed in a third well bore 124. First production leg 102, second production leg 104, and third production leg 106 are assembled and operate in the manner described above for FIGS. 2-5. First, second, and third sets of electrodes can be powered by three-phase electricity in a manner such that the first, second, and third sets of electrodes are each electrified at a different phase. The first end electrode 126, second end electrode 128, and third end electrode 130 are preferably connected to the ground power line, so that each end electrode is neutralized. When electrified, the electrodes cause electricity to pass into the subterranean region in which the well bores 120, 122, 124 are disposed. The electricity flows through electrically conductive brine, and serves to heat heavy oil in the region, thereby lowering its viscosity and enabling it to flow into the production tubing of apparatus 100.

Turning now to FIG. 7, another embodiment of the present invention comprises two lengths of production tubing disposed in well bore 202. Well bore 202 comprises a single vertical portion 204, a first horizontal portion 206, and a second horizontal portion 208. Well bore 202 extends through an oil-bearing subterranean region 210. Vertical portion 204 of well bore 202 is cased with casing 212. First horizontal portion 206 and second horizontal portion 208 of well bore 202 are uncased. Disposed within first horizontal portion 206 of well bore 202 is first heating and production apparatus 214. First heating and production apparatus 214 comprises first production tubing 216, a first electrically insulating body 218, and a first set of electrodes 220. Disposed within second horizontal portion 208 of well bore 202 is second heating and production apparatus 222. Second heating and production apparatus 222 comprises second production tubing 224, a second electrically insulating body 226, and a second set of electrodes 228. In both heating and production apparatuses 214, 222, the insulating bodies 218, 226, sets of electrodes 220, 228, and production tubing 216, 224 are perforated for fluid flow into the respective production tubing. First heating apparatus 214 and second heating apparatus 222 can be assembled and operate in substantially the same manner described above with reference to FIGS. 1-6.

Turning to FIG. 8, another embodiment of the invention involves the completion of oil and/or gas well 300. In this embodiment, the heating and production apparatus 302 comprises production tubing 304, an electrically insulating body 306, and a plurality of electrodes 308. Insulating body 306 is comprised of a low-density material with a specific gravity less than about 1, preferably less than about 0.75. The low density of insulating body 306 enables apparatus 302 to float on liquid 310 in well bore 312. Because apparatus 302 floats on liquid 310, it is easier to move apparatus 302 to the end of the well bore 312.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

We claim:

1. A method for resistively heating a subterranean region of at least one uncased wellbore, said method comprising:

causing electricity to pass through the region between two or more spaced-apart electrodes, said electrodes being coupled to and spaced along production tubing disposed within the region, and said electrodes being electrically insulated from the production tubing by an electrically insulating body coupled to said tubing.

2. The method of claim 1, said electrodes being disposed in an uncased open-hole well bore.

3. The method of claim 2, said well bore being oriented substantially horizontally.

4. The method of claim 1, said electrodes being dispersed in two or more uncased well bores.

5. The method of claim 4, said well bores being substantially parallel to one another.

6. The method of claim 5, said electricity passing between the well bores.

7. The method of claim 1, said subterranean region containing highly viscous oil, said oil being resistively heated by the electricity passing through the region to thereby cause the oil to become less viscous.

8. The method of claim 1, said electrodes being disposed within two or more substantially horizontal and substantially co-planar uncased well bores, said electricity passing between said well bores.

9. The method of claim 1, said electrodes being coupled around the outside of the production tubing.

10. The method of claim 9, each of said electrodes extending completely around the production tubing.

11. The method of claim 1, said insulating body extending completely around the production tubing.

12. The method of claim 11, said insulating body extending continuously along at least 300 feet of the length of the production tubing.

13. The method of claim 1, said electrodes being coupled around the insulating body.

14. The method of claim 13, said insulating body, said electrodes, and said production tubing being perforated to permit fluid flow therethrough and into the tubing along a substantial length of the tubing.

15. The method of claim 1, each of said electrodes being electrically coupled to one of a plurality of electrical conductors extending along the production tubing.

16. The method of claim 15, said conductors being electrically insulated from the production tubing by the insulating body.

17. The method of claim 16, said insulating body electrically insulating each of the electrodes from at least one of the conductors.

18. A method for resistively heating a subterranean region, said method comprising:

causing electricity to pass through the region between a first set of two or more electrodes, said first set of electrodes being disposed in an uncased open-hole well bore, said first set of electrodes being coupled to a common length of first production tubing and spaced apart from one another along the length of the first production tubing; and causing electricity to pass through the region between said first set of electrodes and a second set of electrodes coupled to a common length of second production tubing, said second set of electrodes being spaced apart from one another along the length of the second production tubing, said second production tubing being spaced from and extending substantially parallel to the first production tubing, said first production tubing having a first electrically insulating body coupled thereto, said second production tubing having a second electrically insulating body coupled thereto, said first and second production tubing, said electrodes, and said insulating bodies being perforated to permit fluid flow therethrough and into the respective production tubing.

19. The method of claim 18, said first and second production tubing being disposed in two separate, substantially horizontal, substantially parallel uncased well bores.

20. The method of claim 18, said electrodes being spaced apart from one another by at least 25 feet.

21. The method of claim 20, said electrodes being spaced apart in the range of from about 50 feet to about 200 feet.

22. The method of claim 20, said first set of electrodes comprising at least four individual electrodes.

23. A method for resistively heating a subterranean region, said method comprising:

causing electricity to pass through the region between a first set of two or more electrodes, said first set of electrodes being disposed in an uncased open-hole well bore, said first set of electrodes being coupled to a common length of first production tubing and spaced apart from one another along the length of the first production tubing; and causing electricity to pass through the region between said first set of electrodes and a second set of electrodes coupled to a common length of second production tubing, said second set of electrodes being spaced apart from one another along the length of the second production tubing, said second production tubing being spaced from and extending substantially parallel to the first production tubing, said first production tubing having a first electrically insulating body coupled thereto, said second production tubing having a second electrically insulating body coupled thereto, each of said first and second insulating bodies housing at least four power lines, three of said power lines being configured to carry three-phase electricity, a fourth one of the power lines being configured to act as a ground.

24. The method of claim 23, said electrodes comprising metallic rings through which the power lines run, each of said electrodes being connected to at least one of the power lines by a contact means to thereby electrify or ground the electrode.

25. The method of claim 24, further comprising:

using a plurality of spaced-apart thermocouples coupled along the length of the first production tubing to create a temperature profile of the subterranean region.

26. The method of claim 25, further comprising:

selectively electrifying or grounding the electrodes in order to optimize the temperature profile.

27. A reservoir heating apparatus configured for attachment to production tubing, said apparatus comprising:

an elongated electrically insulating body; and a plurality of electrically conductive electrodes, said apparatus being shiftable between a disassembled configuration wherein the apparatus is decoupled from the tubing and an assembled configuration wherein the apparatus is coupled to the production tubing;

said electrodes being spaced from one another along the length of the body when the apparatus is in the assembled configuration; and said body electrically insulating the electrodes from the tubing when the apparatus is in the assembled configuration.

28. The reservoir heating apparatus of claim 27, said production tubing and said insulating body being perforated to permit fluid flow into the production tubing in the assembled configuration.

29. The reservoir heating apparatus of claim 27, said electrodes being spaced apart by at least about 25 feet when the apparatus is in the assembled configuration.

30. The reservoir heating apparatus of claim 27, said electrodes being spaced apart in the range of from about 50 feet to about 200 feet when the apparatus is in the assembled configuration.

31. The reservoir heating apparatus of claim 27, further comprising:

a plurality of separate power lines at least partly disposed in the insulating body and extending along the production tubing when the apparatus is in the assembled configuration.

32. The reservoir heating apparatus of claim 31, further comprising:

an electrical connector associated with each electrode and operable to electrically couple the electrode to one of the power lines when the apparatus is in the assembled configuration.

33. The reservoir heating apparatus of claim 32, said electrical connector comprising a jumper screw.

34. The reservoir heating apparatus of claim 32, said electrical connector comprising a switch.

35. The reservoir heating apparatus of claim 34, further comprising:

a control line disposed in the insulating body and connected to each of the switches when the apparatus is in the assembled configuration, said control line being capable of controlling each individual switch so that the electrical connection between the power lines and each electrode can be selectively switched on and off.

36. The reservoir heating apparatus of claim 31, each of said electrodes comprising an electrically conductive ring surrounding the insulating body and power lines when the apparatus is in the assembled configuration.

37. The reservoir heating apparatus of claim 36, said electrodes being about 1 to about 10 feet in length.

38. The reservoir heating apparatus of claim 27, said apparatus including one or more thermocouples attached to the body.

39. The reservoir heating apparatus of claim 38, said thermocouples comprising a fiber optic cable disposed within the insulating body.

40. A system for resistively heating a subterranean region, said system comprising:

a first length of production tubing;

a second length of production tubing spaced from the first length of production tubing;

a series of electrically connected first electrodes spaced along the length of the first length of production tubing; and a series of electrically connected second electrodes spaced along the length of the second length of production tubing, and said first electrodes being electrically insulated from the first length of production tubing by a first electrically insulating body coupled to the first length of production tubing.

41. The system of claim 40, at least a portion of said first and second lengths of production tubing being oriented substantially horizontally.

42. The system of claim 40, further comprising:

a second insulating body coupled to the second length of production tubing.

43. The system of claim 42, said first and second insulated bodies insulating the first and second electrodes from the first and second lengths of production tubing, respectively.

44. The system of claim 42, said first and second insulating bodies having a specific gravity less than about 1.

45. The system of claim 44, said first and second insulating bodies having a specific gravity less than about 0.75.

46. The system of claim 40, further comprising:

a first set of two or more separate power lines coupled to and extending along the first length of production tubing; and a second set of two or more separate power lines coupled to and extending along the length of the second length of production tubing.

47. The system of claim 46, said first and second electrodes comprising metallic rings through which the first and second sets of power lines run, respectively.

48. The system of claim 46, further comprising:

an electrical connector associated with each electrode and operable to connect each electrode to one of the power lines.

49. The system of claim 48, said electrical connector being a jumper screw.

50. The system of claim 48, said electrical connector being a switch

.

* * * * *